US006247728B1

(12) United States Patent
Verville

(10) Patent No.: US 6,247,728 B1
(45) Date of Patent: Jun. 19, 2001

(54) DEVICE FOR SUPPORTING SNOWBOARD

(76) Inventor: Richard C Verville, 45-715 Puohala St., Kaneohe, HI (US) 96744

( * ) Notice: Subject to any disclaimer, the term of this patent is extended or adjusted under 35 U.S.C. 154(b) by 0 days.

(21) Appl. No.: 09/628,234

(22) Filed: Jul. 28, 2000

(51) Int. Cl.[7] ..... A63C 11/02; A63C 11/16
(52) U.S. Cl. ..... 280/811; 280/809; 280/814
(58) Field of Search ..... 280/809, 811, 280/814; 36/114, 136, 132; D3/261, 254, 201, 215, 221, 218, 226; D19/90

(56) References Cited

U.S. PATENT DOCUMENTS

D. 265,020 * 6/1982 Silton ..... D3/226
D. 368,167 * 3/1996 Zeri ..... D6/317
D. 396,143 * 7/1998 McLaughlin ..... D3/201
2,933,324 * 4/1960 Stimler ..... 280/809
4,152,002 * 5/1979 Olson ..... 280/814
4,504,993 * 3/1985 Gamble ..... 7/165
4,699,415 * 10/1987 Skovajsa ..... 294/147
5,058,524 * 10/1991 Guthrie, Jr. ..... 116/209

* cited by examiner

*Primary Examiner*—Brian L. Johnson
*Assistant Examiner*—Bridget Avery

(57) ABSTRACT

A thin curved body (1) forming a hook shape which grips the binding of the snowboard. There is a slot (3) or eyelet holes (2) used to mount the body to the users footwear.

1 Claim, 1 Drawing Sheet

DEVICE FOR SUPPORTING SNOWBOARD

CROSS-REFERENCE TO RELATED APPLICATIONS

Not Applicable.

FIELD OF INVENTION

This invention relates to snowboards, specifically to the support of the board while on the chair lift.

BACKGROUND—DESCRIPTION OF PRIOR ART

The problem my invention solves is that of knee strain. When you get on a chair lift one leg must be free from the board. Once on the lift the board is hanging from only the one leg that is still attached. Strain is felt mainly in the knee. This strain is harmful to the ligaments.

I have researched some other solutions to this problem. U.S. Pat. No. 5,564,729 to Gomez (1995) discloses a leash tied to the board, this leash can be tightened to support the board while on the chair lift. This leash seems to hinder movement of the free leg while the rider is queuing for and mounting a chair lift. It also hinders movement when traveling on level ground using push and glide sequence of motions, possibly causing tripping or tangling.

Also introduced to solve this problem of knee strain are U.S. Pat. No. 5,356,159 to Butterfield (1994), called the equalizing hook and U.S. Pat. No. 5,090,722 to Ritchie (1992), called the foot-gripping device. I like these ideas but due to cost and difficulty of installation I think they are not necessary. There already exist traction pads on most snowboards that grip your free boot while traversing flat areas. Most people do not possess the skill or tools required to mount these devices on a snowboard, which adds frustration and expense.

SUMMARY

In accordance with the present invention a snowboard-supporting device that comprises of a hook shaped body, having a slot or two eyelets to attach itself to the lacing of the users footwear. Some boots use a VELCRO strap as a lace. The hook with the slot shaped hole will accommodate that style.

OBJECTS AND ADVANTAGES

Some of the advantages are:

1. To provide a support for the snowboard while on the chairlift.
2. Greatly reducing strain to the users knee, ligaments and leg muscles,
3. To provide a support that is as easy to install as lacing your shoe, and
4. To provide a support that can be made of maNy different materials to match styles or budget.

DRAWING FIGURES

REFERENCE NUMERALS IN DRAWINGS

1 body
2 eyelet
3 slot
4 boot

DESCRIPTION—FIGS. 1 AND 2—PREFERRED EMBODIMENT

Figure 1:
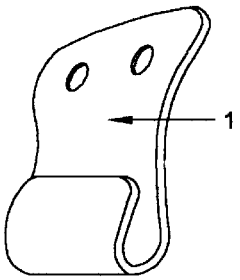
FIG. 1 is a front view of the entire apparatus for the left side of a boot
Figure 2:
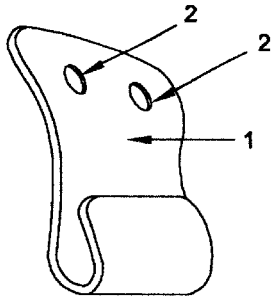
FIG. 2 is a front view of the entire apparatus for the right side of a boot
Figure 3:
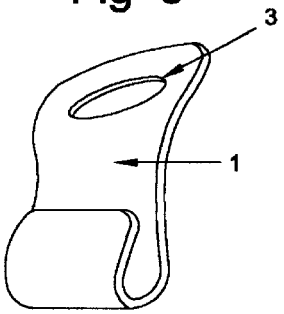
FIG. 3 shows a slot opening for a VELCRO type lace
Figure 4:
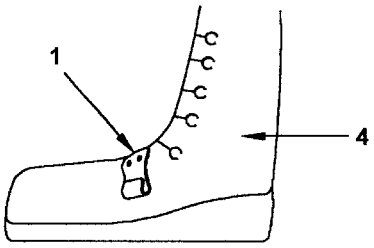
FIG. 4 shows its mounting position on the boot
Figure 5:
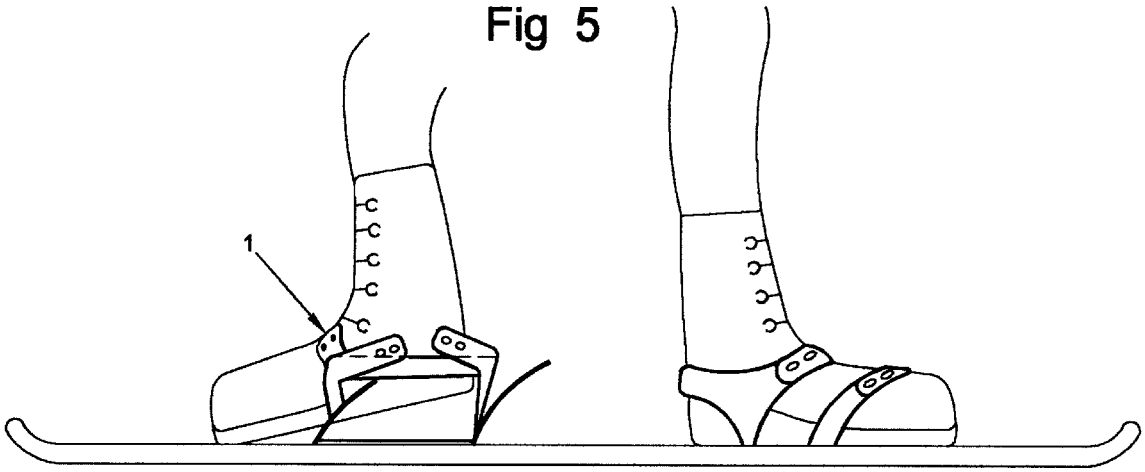
FIG. 5 is a front view of the position of the device when in use on a chair lift.

A preferred embodiment of the hook is illustrated in FIG. 1. The body 1 is made of approximately 4 layers of carbon fiber. This is accomplished by first shaping a piece of STYROFOAM as a mold. The carbon fiber is then fitted over the mold and laminated with epoxy resin. After it hardens you can cut the shape out on a band saw. Dip the hook in acetone and the STYROFOAM will dissolve. Locate and drill the eyelet holes 2 or slot 3. Insert brass eyelet bushings. Add a finish coat of resin. This hook can be made out of any other material that can be bent or formed. It must retain its shape after manufacture. It only needs to support about 10 pounds on the hook. Other materials include but aren't limited to vinyl rubber, plastics, metal, cardboard, etc. Instead of eyelets the hook can be made with a slot that would accept the VELCRO type laces on some boots as in FIG. 3.

Operation

The hook is installed on the user's boot by incorporating the hook while lacing the boot. He can then get on the chair lift as usual. Once on the lift he has the option of supporting the snowboard by placing the hook under the back of the binding. At the end of the lift ride he can slip the hook off of the binding and dismount as usual.

CONCLUSION RAMIFICATION AND SCOPE

Accordingly, the reader will see that the hook can be installed very easily on the user's boot. It will provide support to the board while on the lift, greatly reducing strain to the knees. It is a simple way to solve a serious problem.

What is claimed is:

1. A device for supporting a snowboard having a binding, while on a chair lift, said device comprising:

a hook shaped body made from approximately four layers of carbon fiber;

said body having a vertically extending back portion which curves at one end to for a vertically extending arcuate lip;

an upper portion of said back portion including a transversely arranged slot or eyelet holes for attachment to a user's boot lace or strap; and, said body being generally J-shaped to receive a portion of said snowboard binding between said back portion and said lip to support the user's snowboard while on the chair lift.

* * * * *